US006126709A

United States Patent [19]

Åkerman et al.

[11] Patent Number: 6,126,709

[45] Date of Patent: Oct. 3, 2000

[54] CEMENTED CARBIDE BODY WITH IMPROVED HIGH TEMPERATURE AND THERMOMECHANICAL PROPERTIES

[75] Inventors: Jan Åkerman, Stockholm; Thomas Ericson, Hägersten, both of Sweden

[73] Assignee: Sandvik, Sandviken, Sweden

[21] Appl. No.: 08/886,042

[22] Filed: Jun. 30, 1997

[30] Foreign Application Priority Data

Jul. 19, 1997 [SE] Sweden ..... 9602813

[51] Int. Cl.[7] ..... C22C 29/08

[52] U.S. Cl. ..... 75/240; 75/242

[58] Field of Search ..... 75/240, 142; 419/18, 419/35

[56] References Cited

U.S. PATENT DOCUMENTS

| | | | |
|---|---|---|---|
| 5,071,473 | 12/1991 | Reeder et al. | 75/240 |
| 5,505,902 | 4/1996 | Fischer et al. | 419/10 |
| 5,529,804 | 6/1996 | Bonneau et al. | 427/217 |

FOREIGN PATENT DOCUMENTS 9702154 6/1997 Sweden .

*Primary Examiner*—Ngoclan Mai

*Attorney, Agent, or Firm*—Burns, Doane, Swecker & Mathis, L.L.P.

[57] ABSTRACT

There is now provided a cemented carbide grade for rock excavation purposes with 88–96 weight % WC, preferably 91–95% weight % WC, with a binder phase consisting of only cobalt or cobalt and nickel, with a maximum of 25% of the binder being Ni, possibly with small additions of rare earth metals, such as Ce and Y, up to a maximum of 2% of the total cemented carbide. The WC grains are rounded because of the process of coating the WC with cobalt, and not recrystallized or showing grain growth or very sharp cornered grains like conventionally milled WC, thus giving the bodies surprisingly high thermal conductivity. The average grain size should be from 8–30 $\mu$m, preferably from 12–20 $\mu$m. The maximum grain size does not exceed 2 times the average value and no more than 2% of the grains found in the structure are less than half of the average grain size.

5 Claims, 1 Drawing Sheet

CEMENTED CARBIDE BODY WITH IMPROVED HIGH TEMPERATURE AND THERMOMECHANICAL PROPERTIES

BACKGROUND OF THE INVENTION

The present invention relates to a cemented carbide body useful in applications where extreme cyclic loads and friction forces occur, creating high temperatures and rapid thermomechanical fatigue.

Continuous excavation methods for cutting of soft rock, minerals and roads, such as roadheading, continuous mining, road and concrete planing and trenching, are operations where the cemented carbide tipped tools at one moment are in engagement with the rock or ground and in the next second rotating in the air, often cooled by water. This causes a lot of thermal fatigue stresses as well as mechanical stresses, leading to microchipping and fracturing of the cemented carbide surface, often in combination with rapid high temperature abrasive sliding wear of the tip.

Pressure increases from 0 to 10 tons and temperature increases from room temperature up to 800° C. or 1000° C. in 1/10th of a second are generated at the contact zone between rock and cemented carbide tool tip when the tool enters the rock. This is not unusual today when stronger machines are used at higher cutting speeds in combination with harder and harder minerals, coal or ground to cut. Also, in those percussive or rotary rock drilling applications where extreme heat is being generated, like when drilling in iron ore (magnetite), rapid formation of thermal cracks, so-called "snake skin", occurs.

The properties which are absolutely essential to improve and optimize in the cutting material, i.e., the cemented carbide are:

- thermal conductivity—the materials' ability to lead away or conduct heat, which must be as high as possible;
- thermal expansion coefficient—the linear expansion of the material when heating should be low to assure minimum thermal crack growth rate;
- hardness at elevated temperatures must be high to ensure a good wear resistance at high temperatures;
- transverse rupture strength (TRS) must be high; and
- fracture toughness—the ability of a material to resist catastrophic fracturing from small cracks present in the structure must be high.

It is well-known that the binder metal in cemented carbide, i.e., cobalt (nickel, iron) has a low thermal conductivity and a high thermal expansion coefficient. Therefore, the cobalt content should be kept low. On the other hand, a cemented carbide with high cobalt has a better strength, TRS and fracture toughness, which also is necessary from a mechanical point of view especially when high impact and peak loads are brought to the cemented carbide tip when entering the rock surface at high speed or from machine vibrations under hard cutting conditions.

Also known is that a coarser grain size of the WC phase is beneficial to the performance of the cemented carbide under conditions mentioned above, because of the increased fracture toughness and transverse rupture strength in comparison with more fine grained cemented carbides.

A trend in making tools for mining applications has therefore been to both lower the cobalt content together with increasing the grain size, thus achieving both a fair mechanical strength as well as acceptable high temperature wear properties. A larger grain size than 8–10 μm at a Co content down to 6–8% is not possible to make with conventional methods because of the difficulty to make coarse WC crystals and because of the milling time in the ball mills needed for the necessary mixing of Co and WC and to avoid harmful porosity. Such milling leads to a rapid reduction of the WC grain size and a very uneven grain size distribution after sintering. During sintering, small grains dissolve and precipitate on already large grains at the high temperatures needed to achieve the overall grain size. Grain sizes between 1–50 μm can often be found. Sintering temperatures from 1450°–1550° C. are often used, which also are needed to minimize the risk for excessive porosity because of the low Co contents. An unacceptably high porosity level will inevitably be the result of a too short milling time and/or lowering the cobalt content under 8 weight %. The wide grain size distribution for the coarse grained, conventionally produced cemented carbides is in fact, detrimental for the performance of the cemented carbide. Clusters of small grains of about 1–3 μm as well as single abnormally large grains of 30–60 μm act as brittle starting points for cracks like thermal fatigue cracks or spalling from mechanical overloading.

Cemented carbide is made by powder metallurgical methods comprising wet milling a powder mixture containing powders forming the hard constituents and binder phase, drying the milled mixture to a powder with good flow properties, pressing the dried powder to bodies of desired shape and finally sintering.

The intensive milling operation is performed in mills of different sizes using cemented carbide milling bodies. Milling is considered necessary in order to obtain a uniform distribution of the binder phase in the milled mixture. It is believed that the intensive milling creates a reactivity of the mixture which further promotes the formation of a dense structure during sintering. The milling time is in the order of several hours up to days.

The microstructure after sintering in a material manufactured from a milled powder is characterized by sharp, angular WC grains with a rather wide WC grain size distribution often with relatively large grains, which is a result of dissolution of fine grains, recrystallization and grain growth during the sintering cycle.

The grain size mentioned herein is always the Jeffries grain size of the WC measured on a photograph of a cross-section of the sintered cemented carbide body.

In U.S. Pat. Nos. 5,505,902 and 5,529,804, methods of making cemented carbide are disclosed according to which the milling is essentially excluded. Instead, in order to obtain a uniform distribution of the binder phase in the powder mixture, the hard constituent grains are precoated with the binder phase, the mixture is further mixed with a pressing agent, pressed and sintered. In the first mentioned patent, the coating is made by a SOL-GEL method and in the second, a polyol is used. When using these methods, it is possible to maintain the same grain size and shape as before sintering, due to the absence of grain growth during sintering.

OBJECTS AND SUMMARY OF THE INVENTION

It is an object of this invention to avoid or alleviate the problems of the prior art.

It is further an object of this invention to provide a cemented carbide body useful in applications where extreme cyclic loads and friction forces occur.

In one aspect of the invention there is provided a cemented carbide for rock excavation purposes with 88–96 weight % WC with a binder phase of only cobalt or cobalt and nickel, with a maximum of 25% of the binder being Ni and up to a maximum of 2% of the total cemented carbide composition of rare earth metals, the WC grains being rounded, the average grain size being 8–30 μm with the maximum grain size not exceeding 2 times the average value and no more than 2% of the grains found in the structure being less than half of the average grain size.

In another aspect of the invention there is provided a method of making a cemented carbide for rock excavation purposes with an average WC grain size of 8–30 μm comprising jetmilling with or without sieving a coarse WC powder to a powder with narrow grain size distribution in which the fine and coarse grains are eliminated, coating the obtained WC powder with Co, wet mixing without milling the coated WC powder with a pressing agent and thickeners and optionally more Co to obtain the desired final composition to form a slurry, spray drying the slurry to a powder and pressing and sintering the powder.

DETAILED DESCRIPTION OF THE PREFERRED EMBODIMENTS OF THE INVENTION

Figure 1:
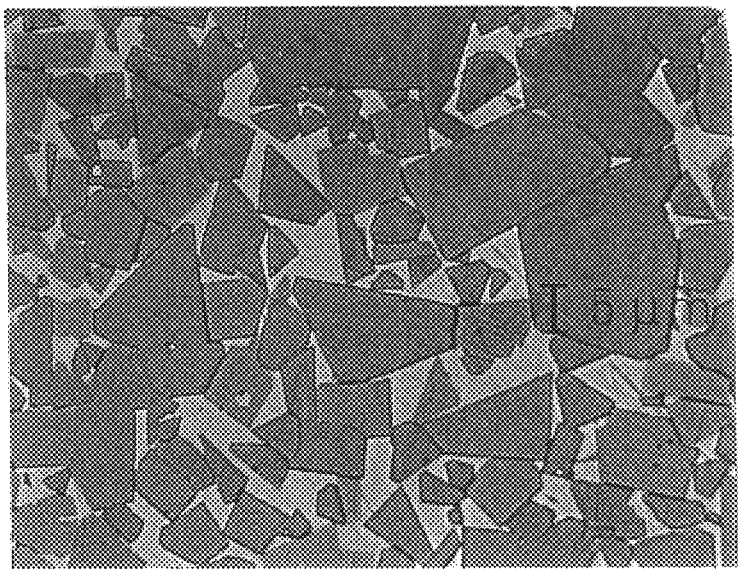
FIG. 1 shows in 1200× magnification the microstructure of a WC-Co cemented carbide according to prior art with an average grain size of 8–10 μm.

It has now surprisingly turned out that with the processes of U.S. Pat. Nos. 5,505,902 and 5,529,804, both herein incorporated by reference, it is possible to make cemented carbide with extremely coarse and uniform WC grain size with excellent hardness and toughness properties at very high temperatures. By jetmilling, deagglomeration and fraction sieving of standard coarse WC, only using the very coarse fraction, and coating the WC with cobalt by the SOL-GEL technique, cemented carbide grades with perfectly uniform grain size at 13–14 μm and 17–20 μm have been produced with porosity less than A02-B02 at only 6 weight % Co content. This is absolutely impossible with conventional methods.

It has further been surprisingly found that both mechanical fatigue and thermal properties have substantially been improved in cemented carbide used for cutting of harder formations, such as sandstone and granite. The absence of recrystallization of the WC during sintering, the absence of grain growth and dissolution or coalescence of grains because of the new technique has resulted in a very strong and continuous WC skeleton with surprisingly good thermal and mechanical properties.

The contiguity of the WC skeleton is much higher than for a conventionally milled powder WC-Co. Grades made by conventional processes have failed to perform when cutting in harder formations like granite and hard sandstone, showing totally collapsed surfaces where the cobalt has melted, the more elongated and hexagonal WC grains are crushed and collapsed and whole parts of the tip slide away because of the extreme heat. Cracks have soon grown so big that the final fracture state is reached within a few minutes.

Grades made according to the present invention have clearly managed to cut in hard formations for long times showing a stable wear pattern without deep cracks. Because of the high contiguity of the WC skeleton, the thermal conductivity has been found to be 134 W/m° C., for a 6% Co grade with an even grain size of 14 μm. This is surprisingly high and a value normally given for pure WC, which means that these rounded, uniform and coarse WC grains in good contact with each other totally determine the conduction of heat throughout the cemented carbide body keeping the tip point unexpectedly cool even at high friction forces. The very few grain boundaries between WC/WC and WC/Co in a coarse grained grade in comparison to a fine grained material also appear to contribute a lot to the excellent thermal conductivity because of the fact that the heat transfer through a grain boundary is slower than in the pure grain itself.

The thermal conductivity must be higher than 130 W/m° C. for a grade with 5–7% Co.

The contiguity, C, should be >0.5 being determined by lineal analysis $$C = \frac{2 \cdot N_{WC/WC}}{2 \cdot N_{WC/WC} + N_{WC/binder}}$$

where $N_{WC/WC}$ is the number of carbide/carbide and $N_{WC/binder}$ the number of of carbide/binder boundaries per unit length of the reference line.

The contiguity for a cemented carbide containing 6% Co and having a uniform grain size of 10 μm made according to the present invention is 0.62–0.66, i.e., >0.6. For a conventionally made cemented carbide containing 6% Co and a grain size of 8–10 μm, the contiguity is only 0.42–0.44.

High temperature hardness measurements have surprisingly shown that from 400° C., the decrease in hardness with increasing temperature is much slower for a uniform and very coarse cemented carbide structure, in comparison to a grade with finer or more uneven grain size. A grade with 6% Co and 2 μm grain size with a hardness of 1480 $HV_3$ at room temperature was compared with a 6% Co grade and 10 μm grain size with a room temperature hardness of 1000 $HV_3$. At 800° C., the fine grained grade had a hardness of 600 $HV_3$ and the grade according to the present invention had nearly the same, or 570 $HV_3$.

The strength values, e.g., the TRS values, are up to 20% higher and with a third of the spread for a body made according to the present invention in comparison with a conventionally made body having the same composition and average grain size.

According to the present invention, there is now provided a cemented carbide grade for rock excavation purposes with 88–96 weight % WC, preferably 91–95 weight % WC, with a binder phase consisting of only cobalt or cobalt and nickel, with a maximum of 25% of the binder being nickel, possibly with small additives of rare earth elements, such as Ce and Y, up to a maximum of 2% of the total composition. The WC grains are rounded because of the process of coating the WC with cobalt, and not recrystallized or showing grain growth or very sharp cornered grains like conventionally milled WC. The average grain size should be from 7–30 μm, preferably from 10–20 μm. To provide a cemented carbide with the above-mentioned good thermomechanical properties, the contiguity must be over 0.5 and therefore the grain size distribution band must be very narrow. The maximum grain size should not exceed 2 times the average value and no more than 2% of the grains found in the structure be under half of the average grain size.

In a preferred embodiment useful in cutting of hard rock, e.g., tunnelling applications with roadheaders, or cutting of hard coal where the sandstone roof and floor also are cut, a cemented carbide with a binder phase content of 6–8% and an average grain size of 12–18 μm is advantageous.

In another preferred embodiment useful for percussive or rotary drilling in extremely "snake skin" forming rocks, a cemented carbide with 5–6% binder phase and 8–10 μm average grain size is favorable.

According to the method of the present invention, cemented carbide for rock excavation purposes is manufactured by jetmilling with or without sieving a WC powder to a powder with narrow grain size distribution in which the fine and coarse grains are eliminated. This WC powder is then coated with Co according to the processes of U.S. Pat. No. 5,505,902 or U.S. Pat. No. 5,529,804. The WC powder is carefully wet mixed to a slurry, possibly with more Co to obtain the desired final composition and pressing agent. Furthermore, in order to avoid sedimentation of the coarse WC particles, thickeners can, if desired, be added according to Swedish Patent Application 9702154-7. The mixing shall be such that a uniform mixture is obtained without milling, i.e., no reduction in grain size shall take place. The slurry is dried by spray drying. From the spray dried powder, cemented carbide bodies are pressed and sintered according to standard practice.

The invention is additionally illustrated in connection with the following Examples which are to be considered as illustrative of the present invention. It should be understood, however, that the invention is not limited to the specific details of the Examples.

EXAMPLE 1

In a coal mine in the Witbank area in South Africa, a test with point attack picks in a continuous mining operation was conducted.

| | |
|---|---|
| Machine: | Joy Continuous Miner HM |
| Drum width: | 6 m |
| Diameter: | 1.6 m |
| Cutting Speed: | 3 m/s |
| Watercooling: | 20 bars from rear of toolbox |
| Tools: | 54 boxes with alternating tools from Variants A and B |
| Shanks: | 25 mm |
| Carbide: | 16 mm diameter with conical top |
| Seam: | Abrasive coal with high pyrite content. Sandstone roof. |
| Coal seam height: | 3.8 m |

Variant A: 8% Co and 8–10 μm WC grain size with wide grain size distribution, conventionally made by milling WC and Co powder in a ball mill together with pressing agents+milling fluid and then spray dried. The microstructure is shown in FIG. 1.

Figure 2:
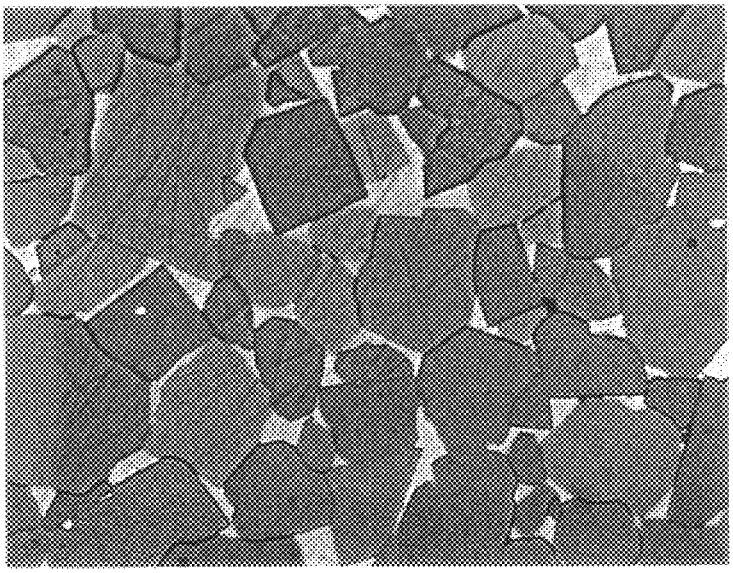
FIG. 2 shows in 1200× magnification the microstructure of a WC-Co cemented carbide according to the present invention with an average grain size of 9–11 μm.

Variant B: 8% Co and 10 μm WC grain size made according to U.S. Pat. No. 5,505,902, where a deagglomerated and sieved WC powder of a grain size of 9–11 μm and a narrow grain size distribution (the maximum grain size not exceeding 2 times the average grain size and less than 2% of the grains being less than half of the average grain size) had been coated with Co to provide 8% Co in the final body and carefully blended with milling fluid+pressing agents and thickeners and then spray dried. This is in accordance with the present invention. The microstructure is shown in FIG. 2.

Cemented carbide bodies were made by pressing and sintering in accordance with conventional techniques from both variants and were brazed into the tools with J&M's S-bronze in the same run.

Results: After cutting out a 6 m wide and 14 m deep section, or 520 tons of coal, heavy vibrations and bouncing of the machine were noticed because of the big stone inclusions appearing in the top of the seam, and the roof level was suddenly dropping 200 mm. The machine was stopped and the tools inspected.

Variant A: 11 tools with fractured cemented carbide. 6 tools were worn out. Replaced 17 tools.

Variant B: 4 tools with fractured cemented carbide. 3 tools were worn out. Replaced 7 tools.

After two shifts, all the tools were taken out. 1300 tons of coal were cut totally and the test stopped.

Variant A: 7 tools fractured. 16 tools were worn out. 4 tools were still O.K.

Variant B: 2 tools fractured. 10 tools were worn out. 15 tools were still O.K.

Variant A: 14 tons/pick of coal produced.

Variant B: 24 tons/pick of coal produced.

EXAMPLE 2

In a test rig at Voest-Alpine laboratories in Zeltwag, Austria, a test in granite blocks was conducted. A boom with cutter head from an Alpine Miner AM 85 was used with only one tools cutting in a stone (1×1×1 $m^3$), which was moved 90° to the cutting direction.

| Machine parameters: | |
|---|---|
| Cutting speed: | 1.37 m/s |
| Cutting depth: | 10 mm |
| Spacing: | 20 mm |
| Maximum force: | 20 tons |
| Stone: | Granite with a compressive strength of 138 MPa |
| Quartz content: | 58% |
| Chechar cuttability index: | 3.8 |
| Tools: | 1500 mm long roadheader picks with stepped shank 30–35 mm. |
| Cemented carbide: | brazed in inserts 35 mm long, diameter 25 mm |
| Weight: | 185 g |

Variant A: 6% Co, 9–10 μm grain size, conventionally made with a hardness of 1080 $HV_3$.

Variant B: 8% Co, 9–10 μm grain size, conventionally made with a hardness of 980 $HV_3$.

Variant C: 6% Co, 14–15 μm perfectly even grain size (i.e., about 95% of all grains within 14–15 μm), made according to the invention as described in Example 1 with a hardness of 980 $HV_3$.

Three tools per variant were tested up to 100 m length of cut in the stone. Cooling with a water nozzle from behind. Water pressure was 100 bar. Pick rotation was 10° per revolution.

Result:

| Variant | Cut length m | Wear mm/m | Wear gram/m | Note |
|---|---|---|---|---|
| A | 200 | 0.18 | 0.39 | 2 tools with broken tips after 50 m |
| B | 240 | 0.23 | 0.58 | 1 tool broken after 40 m; 2 tools worn out |
| C | 300 | 0.07 | 0.18 | all tools slightly worn, but intact |

The excellent result in Example 2 is due to the fact that the cemented carbide of Variant C was working at lower temperatures due to the higher thermal conductivity, thus resulting in a better hardness and wear resistance. The TRS values of Variant C were 2850±100 N/mm$^2$ which is surprisingly higher than that of Variant B with the same hardness. This, of course, also contributes to the superior result for the cemented carbide made according to the invention. TRS for Variant B; 2500±250 N/mm$^2$ and Variant A: 2400±360 N/mm$^2$.

EXAMPLE 3

Bits for percussive tube drilling with two types of cemented carbide buttons were made and tested in LKAB's iron ore in Kiruna. The cemented carbide had a WC grain size of 8 μm, a cobalt content of 6 weight % and a WC content of 94 weight %.

Variant A: Powders of Co, WC, pressing agents and milling fluids in desired amounts were milled in ball mills, dried, pressed and sintered by conventional methods. The carbide had a microstructure with wide grain size distribution.

Variant B: WC powder was jetmilled and separated in the grain size interval 6.5–9 μm and then coated with cobalt by the method disclosed in U.S. Pat. No. 5,505,902. Pure Co powder is added to result in a WC powder with 6 weight % cobalt. This powder was carefully mixed without milling with desired amounts of cobalt, thickeners, milling fluids and pressing agents. After drying, the powder was compacted and sintered resulting in a microstructure with narrow grain size distribution with >about 95% of all grains between 6.5 and 9 μm.

The contiguity for both variants was determined:

Variant A: 0.41

Variant B: 0.61

Buttons with a diameter of 14 mm (periphery and front) were made from both variants and pressed into five bits each. The bits had a flat faced front and a diameter of 115 mm. The test rig was a Tamrock SOLO 60 with a HL1000 hammer and the drilling parameters:

Impact pressure: about 175 mbar

Feeding pressure: 86–88 bar

Rotary pressure: 37–39 bar, about 60 rpm

Penetration rate: 0.75–0.95 m/min

The test was performed in magnetite ore, which generates high temperatures and "snake skin" due to thermal expansions in the wear surfaces.

Results:

Variant A: After drilling 100 m, the buttons showed a thermal crack pattern. When studying a cross-section of a worn surface of a button from one bit, small cracks were found propagated into the material. These cracks cause small breakages in the structure and the buttons will have a shorter lifetime. The average lifetime after regrinding every 100 m for the bits was 530 m.

Variant B: After drilling 100 m, the buttons showed no or minimal thermal crack pattern. The cross-section of the microstructure showed no cracks propagating into the material. Only small parts of cracked grains at the worn surface were visible. The average lifetime for these bits after regrinding ever 200 m was 720 m.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cemented carbide for rock excavation purposes with 88–96 weight % WC with a binder phase of only cobalt or cobalt and nickel, with a maximum of 25% of the binder being Ni and up to a maximum of 2% of the total cemented carbide composition of rare earth metals, the WC grains being rounded, the average grain size being 12–20 μm with the maximum grain size not exceeding 2 times the average value and no more than 2% of the grains found in the structure being less than half of the average grain size.

2. A cemented carbide for rock excavation purposes with 88–96 weight % WC with a binder phase content of 6–8% the binder phase comprising only cobalt or cobalt and nickel, with a maximum of 25% of the binder being Ni and up to a maximum of 2% of the total cemented carbide composition of rare earth metals, the WC grains being rounded, the average grain size being 12–18 μm with the maximum grain size not exceeding 2 times the average value and no more than 2% of the grains found in the structure being less than half of the average grain size.

3. A cemented carbide for rock excavation purposes with 88–96 weight % WC with a binder phase content of 5–6% the binder phase comprising only cobalt or cobalt and nickel, with a maximum of 25% of the binder being Ni and up to a maximum of 2% of the total cemented carbide composition of rare earth metals, the WC grains being rounded, the average grain size being 8–10 μm with the maximum grain size not exceeding 2 times the average value and no more than 2% of the grains found in the structure being less than half of the average grain size.

4. A cemented carbide for rock excavation purposes with 88–96 weight % WC with a binder phase of only cobalt or cobalt and nickel, with a maximum of 25% of the binder being Ni and up to a maximum of 2% of the total cemented carbide composition of rare earth metals, the WC grains being rounded, the average grain size being 8–30 μm with the maximum grain size not exceeding 2 times the average value and no more than 2% of the grains found in the structure being less than half of the average grain size, the cemented carbide having a thermal connectivity >130 W/m° C. and 5–7% Co.

5. A cemented carbide body comprising:

88–96 weight % WC, the WC forming rounded grains having an average grain size of 8–30 μm, the WC grains having a maximum grain size not exceeding 2 times the average grain size value and no more than 2% of the grains found in the structure being less than half of the average grain size;

a binder phase comprising one of cobalt or cobalt combined with a maximum of 25% nickel; and at least one rare earth metal in an amount >0% and ≦2%.

* * * * *

UNITED STATES PATENT AND TRADEMARK OFFICE

CERTIFICATE OF CORRECTION

PATENT NO. : 6,126,709
DATED : October 3, 2000
INVENTOR(S) : Jan Åkerman et al.

It is certified that error appears in the above-identified patent and that said Letters Patent is hereby corrected as shown below:

Title page,
Item [30], Foreign Application Priority Data, please delete "July 19, 1997 [SE] Sweden …….. 9602813" and insert therefor -- July 19, 1996 [SE] Sweden …….. 9602813 --.

Signed and Sealed this

Twenty-ninth Day of June, 2004

JON W. DUDAS
*Acting Director of the United States Patent and Trademark Office*